US006581933B1

(12) United States Patent
Zivan

(10) Patent No.: US 6,581,933 B1
(45) Date of Patent: Jun. 24, 2003

(54) THREE-DIMENSIONAL, ROTATABLE, PYRAMID GAME

(76) Inventor: George Zivan, 2699 Knight Dr., Troy, MI (US) 48085

( * ) Notice: Subject to any disclaimer, the term of this patent is extended or adjusted under 35 U.S.C. 154(b) by 0 days.

(21) Appl. No.: 10/105,851

(22) Filed: Mar. 26, 2002

(51) Int. Cl.[7] ..... A63F 3/00

(52) U.S. Cl. ..... 273/241; 273/249; 273/285; 273/264; 273/287; 273/148 A; 273/280

(58) Field of Search ..... 273/241, 147, 273/264; D21/23

(56) References Cited

U.S. PATENT DOCUMENTS

| | | | | |
|---|---|---|---|---|
| 3,656,755 A | | 4/1972 | Thompson | |
| 3,706,456 A | * | 12/1972 | Sesti et al. | 273/276 |
| 3,884,474 A | | 5/1975 | Harper | |
| 4,082,283 A | * | 4/1978 | La Ferla et al. | 273/241 |
| 4,129,303 A | * | 12/1978 | Flagg | 273/241 |
| 4,591,161 A | * | 5/1986 | Vanderhoof | 273/272 |
| 4,637,609 A | * | 1/1987 | Vanderhoof | 273/272 |
| 4,666,162 A | * | 5/1987 | Campbell | 273/249 |
| 5,004,245 A | * | 4/1991 | Schumacher et al. | 273/241 |
| 5,026,068 A | * | 6/1991 | Weisser | 273/241 |
| 5,058,368 A | * | 10/1991 | Wheeler | 56/13.1 |
| 5,100,150 A | | 3/1992 | Larman | |
| 5,112,056 A | * | 5/1992 | Ching | 273/241 |
| D328,475 S | * | 8/1992 | Gould et al. | D21/23 |
| D356,343 S | | 3/1995 | Londono | |
| 5,409,234 A | | 4/1995 | Bechter | |
| 5,518,247 A | | 5/1996 | Robichaud | |
| 5,662,329 A | | 9/1997 | Nason | |
| 6,032,956 A | | 3/2000 | Bogucz | |
| 6,050,567 A | | 4/2000 | Zucco | |
| 6,276,685 B1 | | 8/2001 | Sterling | |

FOREIGN PATENT DOCUMENTS

| | | | | |
|---|---|---|---|---|
| FR | 2 592 809 A1 | * | 1/1986 | A63F/3/00 |
| GB | 2 228 422 A | * | 8/1990 | A63F/3/00 |

* cited by examiner

*Primary Examiner*—Benjamin H. Layno
*Assistant Examiner*—Dolores R. Collins
(74) *Attorney, Agent, or Firm*—Leonard J. Meraw

(57) ABSTRACT

The invention is a three-dimensional, pyramid-shaped, word forming game having a plurality of levels independently rotatable around a vertical support column secured to a base. The game is played with cards of four different colors, which correspond to the same colors of the pyramids' sides. Players take turns inserting playing cards into card holding slots located on the outer edges of the levels in an attempt to spell words. The levels freely rotate in either direction. Each letter-bearing card has a point value associated with it and players earn points for words spelled on the pyramid shaped game. The game is won by the player with the most points for words spelled out on the game.

8 Claims, 3 Drawing Sheets

THREE-DIMENSIONAL, ROTATABLE, PYRAMID GAME

BACKGROUND OF THE INVENTION

1. Field of the Invention

The invention relates to the broad field of board games, and more specifically, to a three-dimensional, multi-level rotatable, game with different play areas.

2. Description of Related Art

All types of board games, some using dice, cards, playing pieces, spinners, timers, etc., have been known and in use since antiquity. The Egyptians, for example, used dice and planar board games made from wood, inlaid with more precious woods. More recently, chess and checkers Were popular games of the $20^{th}$ century, and their usage continues to date.

Board games contain a variety of markings, or spaces, on their surfaces, whereas, others form geometric shapes. Colored spaces and playing pieces are common, as are cards of different sizes and shapes.

Recent typical (flat) board games with playing pieces and cards can be found, for example, in U.S. Pat. Nos. 6,032,956 and 6,050,567 issued to Bogucz and Zucco respectively.

A probable desire for more intricate board games, coupled with the availability of light weight plastic materials, resulted in three-dimensional board games having multiple levels and various playing pieces, including cards, spinners and tokens.

Thompson, in U.S. Pat. No. 3,656,755, discloses a five, pentagonally shaped, level game using circular playing pieces. The levels are spaced apart by threaded support rods, and the bottom most level forms the base of the game.

Another three-dimensional board game is the subject of U.S. Pat. No. 3,884,474, issued to Harper. His invention comprises rectangular, multi-tiered boards spaced apart by a column anchored to a base. The game is designed for tic-tac-toe, or the like.

Larman, in U.S. Pat. No. 5,100,150, describes a word forming game with a rotatable two level board spaced apart by a resilient connector. The game includes a top, and alphabetical playing pieces.

U.S. Design Pat. No. 328,475, issued to Gould et al, discloses the ornamental design for a three-dimensional pyramid game. Another pyramid board game is the subject of U.S. Design Pat. No. 356,343, issued to Londono.

Robichaud, in U.S. Pat. No. 5,518,247, describes a glass, three-dimensional, pyramid game that contains a crystal piece suspended from the interior apex of the pyramid.

A three-dimensional chess-type board game having six levels directly on top of each other, resulting in a pyramid shape, is found in U.S. Pat. No. 5,662,329, issued to Nason.

Additional examples of three-dimensional, multi-level board games are disclosed in U.S. Patent Nos. 4,082,283, 5,409,234, and 6,276,685 B1, respectively issued to La Ferla et al, Bechter and Sterling. Various means of support structures separate the playing boards from one another, and circular playing pieces are the subject of all three patents.

Yet, unfortunately, none of the board games described above offer a reliable, rotatable, three-dimensional game board for multiple payers. Further, many of the games and boards themselves require special playing pieces, in addition to having complicated rules to follow.

SUMMARY OF THE INVENTION

A primary object of the present invention is to provide a simple and reliable three-dimensional, multi-level game, having independently rotatable levels, which overcomes disadvantages and shortcomings found in the related and prior art.

Another object is to provide a game offering challenges and skills unlike known board games.

Yet another object is to provide a board game with no intricate playing pieces, other than a set of specially marked playing cards.

A further object is to provide an easily manufacturable, three-dimensional board game.

The aforesaid objects are accomplished by the three-dimensional, multi-level rotatable, pyramid-shaped, word forming game of the present invention.

DETAILED DESCRIPTION OF THE PREFERRED EMBODIMENTS

Figure 1:
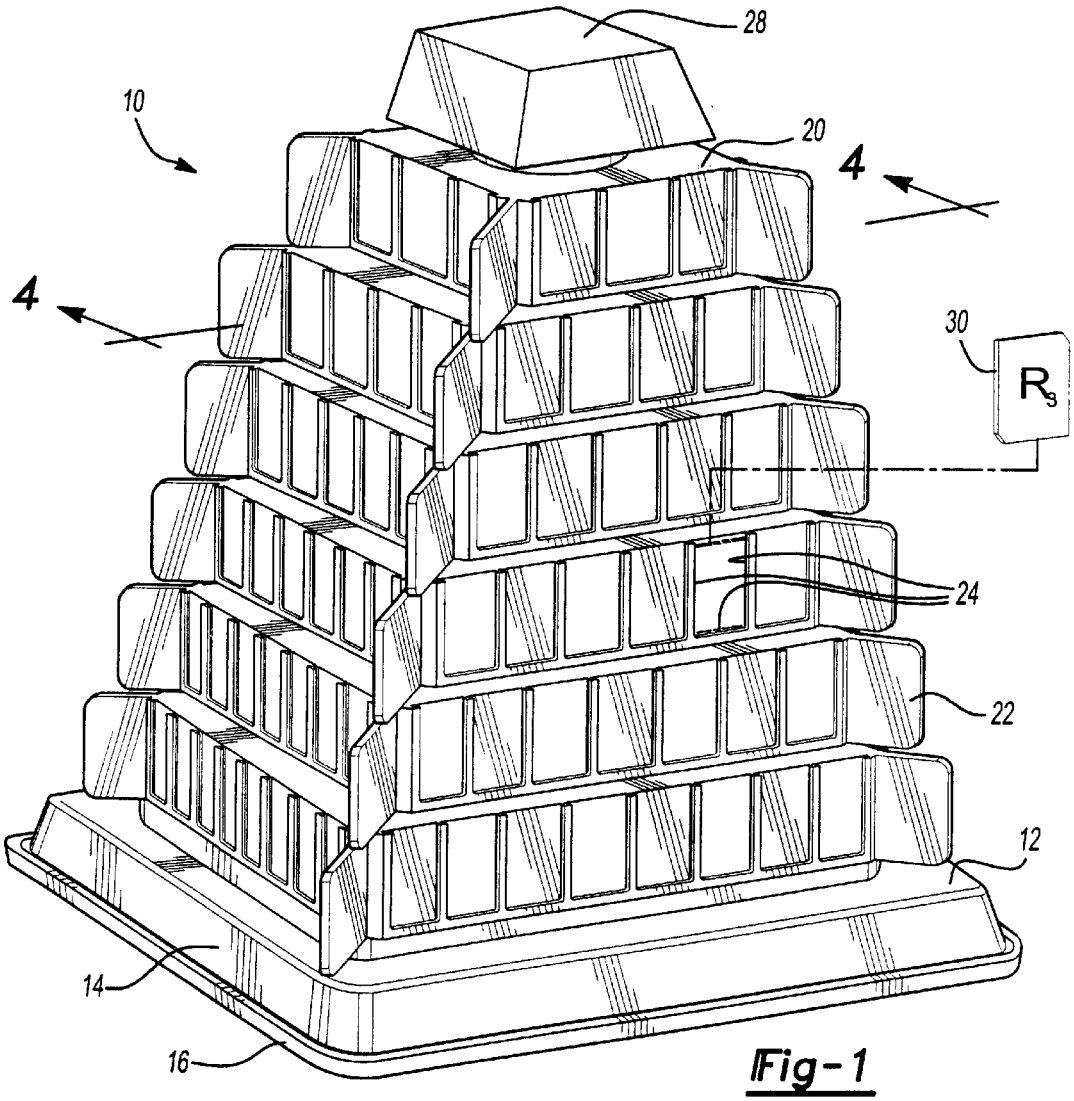
FIG. 1 shows a perspective view of the three-dimensional, multi-level rotatable, pyramid game of the present invention.

As seen in FIG. 1, the three-dimensional, multi-level rotatable, pyramid-shaped game of the present invention, or more simply, the pyramid game 10 comprises a base 12, a plurality of levels 20, and a crown 28. The levels 20 are independently rotatable around a vertical support column 18, visible in FIG. 4. Moreover, the vertical support column 18 is cylindrical, and is held in its upright position by the base 12.

Closer examination of FIG. 1 reveals that each of the levels 20 are generally square in shape, and disposed on each of the four outer corners are individual handles 22. Further, the front outer edges of each level 20 comprise a number of respective card holding slots 24, which receive a typical playing card 30 along three sides of the playing card 30.

FIG. 1 further depicts the base 12 having a beveled edge 14 and a lip 16. Both of these features are continuous around the perimeter of the entire base 12.

Figure 2:
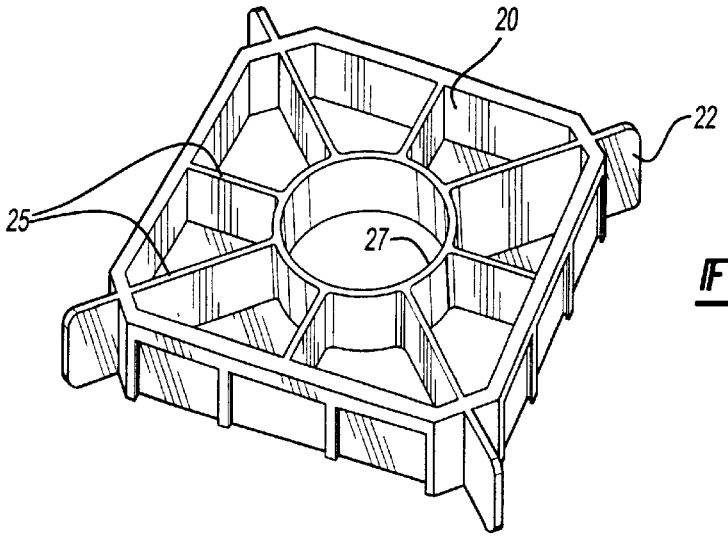
FIG. 2 is a bottom view of upper most level of the three-dimensional, multi-level rotatable, pyramid game of the present invention.

Although the levels 20 have flat planar tops, as evident from FIG. 1, FIG. 2 illustrates that the circular opening formed within the flat top is a, circular, collar 27, which is secured in place to the outer front edges of the level 20 by an internal framework structure 25.

Figure 3:
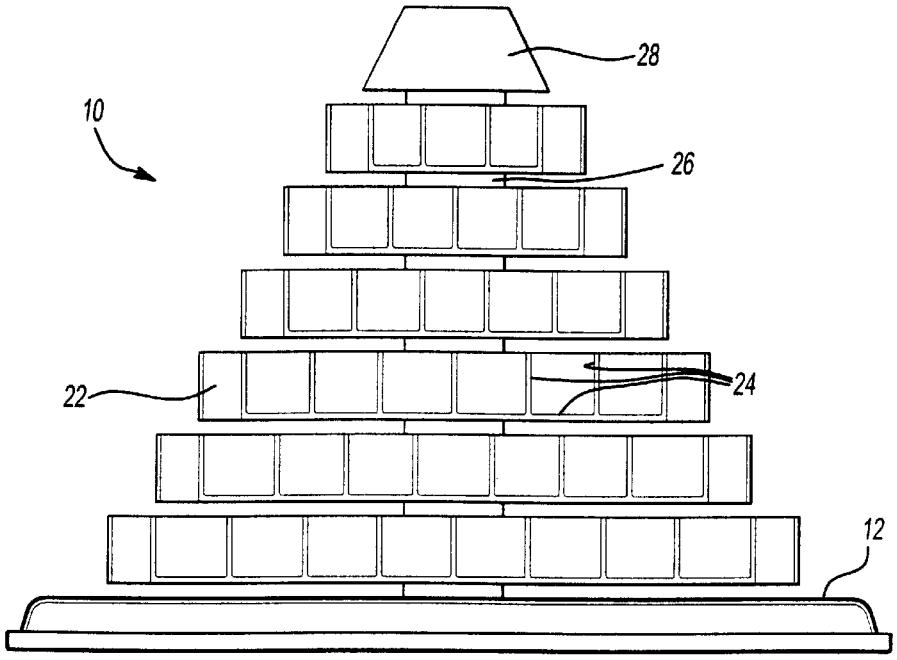
FIG. 3 is a side view of the three-dimensional, multi-level rotatable, pyramid game of the present invention.

FIG. 3 clearly illustrates that the levels 20 are set apart from: each another, the base 12 and the crown 28 respectively by a plurality of, circular, spacer rings 26 disposed in-between each of the aforesaid. The spacer rings 26 fit snugly, yet also independently rotatable, around the vertical support column 18, as more plainly seen in FIG. 4.

Figure 4:
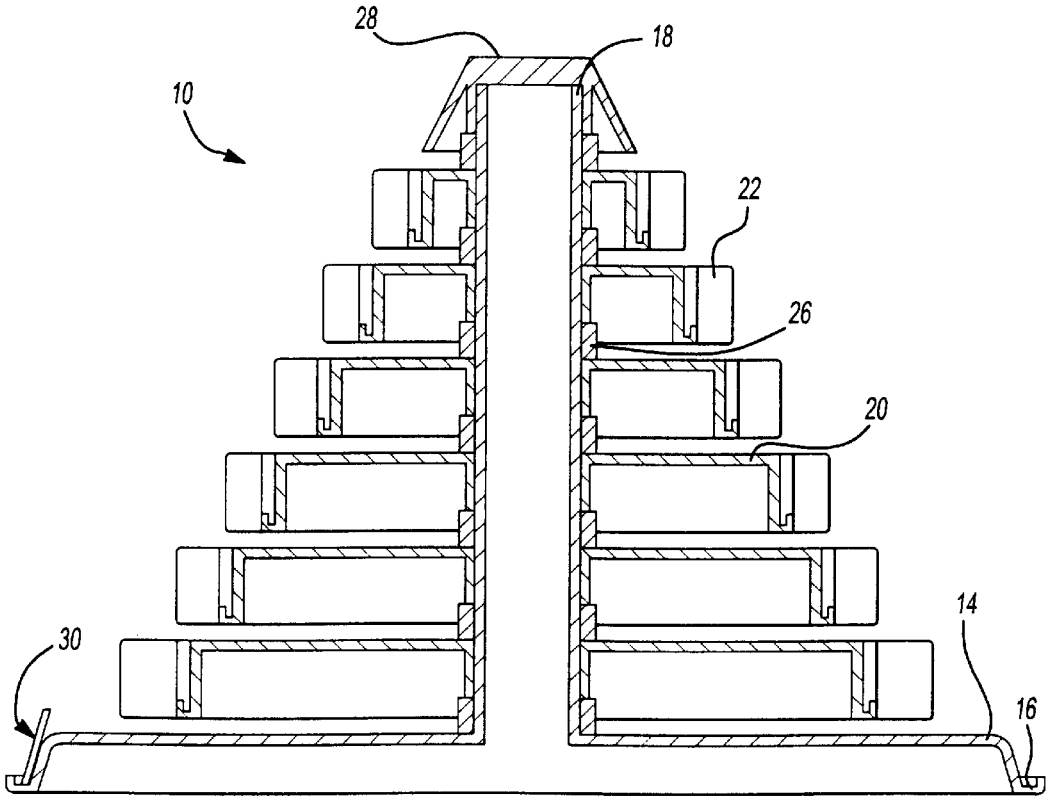
FIG. 4 is a cross sectional view taken along line 4—4 of FIG. 1.

FIG. 4 illustrates the proper positioning of the levels 20, the crown 28, the vertical support column 18, and the base 12 with respect to one another. The stacked combination of the base 12, the levels 20, the spacer rings 26, and the crown 28 enable the pyramid game 10 to be fully operational, i.e., the levels 20 during play are able to turn freely clockwise and counter-clockwise. The secure fit of a level's 20 collar 27, keeps a level 20 from sagging when rotated in either direction. A spacer ring 26 between the crown 28 and the top most level 20 also allows both to rotate independently from one another. Further, FIG. 4 shows a playing card 30 resting within the lip 16 of the beveled edge 14 on the base 12.

Figure 5:
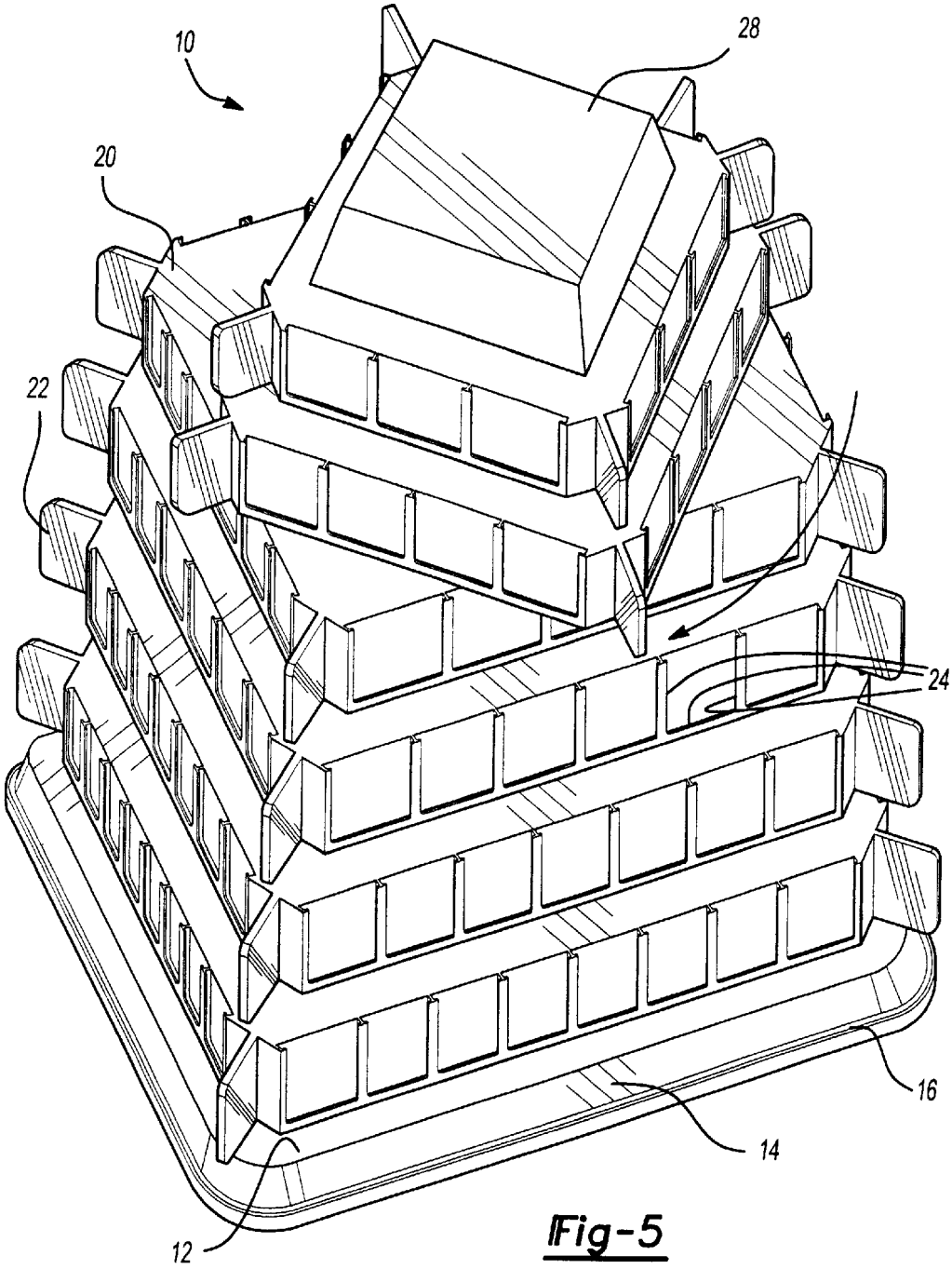
FIG. 5 is a perspective view of the three-dimensional, multi-level rotatable, pyramid game of the present invention seen from a higher sight view than FIG. 1, and shows the rotation of the levels.

Finally, in FIG. 5 the top two levels 20 are shown slightly rotated clockwise. The handles 22 permit the free and easy rotation of the levels 20. It is noted that any of the levels 20 can rotate independently from one another, the base 12, or the crown 28, however, in FIG. 5 two levels 20 and the crown 28 are shown moving together.

In a preferred embodiment of the pyramid-shaped game 10 of the present invention, there are two or more players, who are seated facing a side of the pyramid. Preferably, the sides of the pyramid itself are red, yellow, blue and green; however, various other color combinations are possible. Further, the playing cards 30, totaling 232 as seen in Table 1, corresponds to these four preferred colors.

TABLE 1

| Point Value | Letter | No. of Letters in Deck | Totals |
|---|---|---|---|
| 1 | A, E, I | 20; 5 of each color | 60 |
| 2 | N, O | 16; 4 of each color | 32 |
| 3 | R, T, U | 12; 3 of each color | 36 |
| 4 | D, L, S | 8; 2 of each color | 24 |
| 5 | B, C, G | 8; 2 of each color | 24 |
| 6 | M, P, H | 4; 1 of each color | 12 |
| 7 | F, W, Y | 4; 1 of each color | 12 |
| 8 | K, V | 4; 1 of each color | 8 |
| 9 | J, Q | 4; 1 of each color | 8 |
| 10 | X, Z | 4; 1 of each color | 8 |
| 0 | (Wild Card) | 8; May be any color | 8 |

Initially, each of the players receives 12 cards, and each player may place some of the letter and point bearing playing cards 30 into the lip 16 of the beveled edge 14 on said base 12, or a player may elect to hold all or a portion of the playing cards 30 in their hand. The game commences to the dealer's left and proceeds clockwise. The object of the game 10 is for two or more players to form words by placing cards 30 within the card holding slots 24 facing the player taking their turn.

It is understood that in the context of this game a word is any sequence of cards that when placed next to each other, form either a word, or some other pattern that agree at the start of the game shall constitute an "acceptable entry".

Preferably, each player has up to 5 minutes to form a word. The use of a timer is optional. Once a word is completed, the player advances, or turns, the completed level 20 to face a player on either side. Only one word is allowed to be formed per turn.

The different color playing cards 30 permit a double score bonus when a word is completed in any single color, and allow for a triple score bonus if the same color playing cards 30 correspond to the pyramid's color on that particular side.

A player may pass their turn, if a word cannot be formed. Further, playing cards can be traded among players, or with the dealer, who holds the remaining deck of playing cards 30 not in use. Not only does a handle 22 allow a player to rotate a level 20 during play, but the handle 22 also servers to block the view of an adjacent play, as one player spells out a word within the card holding slots 24 along any one side of a level 20.

The object of the game is to form as many words as possible before any one player runs out of playing cards, thus ending the game. The player who receives the most points after tallying up each of the players' scores wins the game.

Because of the versatility of the multi-level, rotatable playing surfaces on the front outer edges of the levels 20, and of the playing cards 30, which contain designated letters, numbers and colors, a variety of embodiments of the pyramid-shaped game 10 can be created by simple rule changes.

For example, in addition to the formation of words, or instead of requiring the formation of words, another embodiment would allow players to fill their side of a level using cards bearing letters in a certain sequence, such as, P, Q, R, S, T, or cards bearing the very same letter in repetition fashion, such as, E, E, E, E. In addiction, placement of cards that are of the same color, such as, all Green, would be allowed regardless of which letters they contain.

Another embodiment of the three-dimensional, rotatable, pyramid-shaped game 10 would provide for simplified scoring by assigning, for example, a 10 point value to each card played rather than having different values for different letters.

In yet another embodiment of the game, it would be possible, for example, to rotate a combination of levels 20 together, as in FIG. 5, or even every other level 20, which is not shown.

Further, challenges between players can occur and points may be lost, for example, for a misspelled word.

The components of the pyramid-shaped game 10 of the present invention are preferably made from plastic material. Yet, the game 10 could be fabricated from cardboard, or a similar dense paper product.

From the foregoing, one skilled in the art of board games can appreciate that the three-dimensional, multi-level rotatable, pyramid-shaped, word forming game 10 of the present invention offers players many options for different variations of games. Further, one skilled in the art of games will be able to understand changes and modifications of the pyramid-shaped game 10 which would fall within the scope of the invention disclosed herein.

I therefore claim:

1. A method of playing a word forming game, comprising the steps of:

a) providing a three-dimensional, pyramid shaped board game having a plurality of levels independently rotatable around a vertical support column supported by a base, each of said levels being square in shape, each of said levels having four corners, each of said levels having front outer edges defining a multitude of card holding slots, each of said levels having four handles disposed on said corners of said levels, and said three-dimensional, pyramid shaped board game terminating in a crown at its highest point, said crown being affixed to said vertical support column;

b) supplying a number of players with a select amount of playing cards prior to the commencement of said word forming game;

c) placing the cards into any of said card holding slots as each of said players take a turn in succession in said word forming game;

d) continuing placing cards into said card holding slots disposed on said levels until one of said players runs out of said playing cards; and e) tallying up a total score after one of said players runs out of said playing cards, thus ending said word forming game.

2. The method of claim 1 wherein providing said three-dimensional, pyramid shaped board game further comprises providing a beveled edge around the perimeter of said base, and a lip at the outermost portion of said beveled edge for receiving said playing cards.

3. The method of claim 1 wherein said playing cards are a total of four distinct colors.

4. The method of claim 1 wherein said playing cards have a point value and an alphabetical letter on one side of each of said playing cards.

5. The method of claim 1 wherein said word forming game is for said players attempting to obtain the most points for words formed within said card holding slots.

6. The method of claim 1 wherein said card holding slots securely position any of said playing cards onto the front outer edges of said levels independently rotatable around said vertical support column.

7. The method of claim 1 wherein said levels rotatable independently clockwise and counter-clockwise around said vertical support column during said word forming game with the assistance of a plurality of spacer rings.

8. The method of claim 7 wherein each of said levels has a circular collar and an internal framework structure connected thereto, so that each of said levels can advance around said vertical support column.

* * * * *